US006280018B1

(12) United States Patent
Belon et al.

(10) Patent No.: US 6,280,018 B1
(45) Date of Patent: Aug. 28, 2001

(54) AUTOMATIC INK-JET PEN LOADING/ UNLOADING

(75) Inventors: Juan B. Belon, San Diego, CA (US); Jeremy F. Mayer, Gainsville, FL (US); Sergio Escobedo; William H. Schwiebert, both of San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/570,313

(22) Filed: May 12, 2000

(51) Int. Cl.[7] ..... B41J 2/14
(52) U.S. Cl. ..... 347/49
(58) Field of Search ..... 347/85, 86, 87, 347/49; 364/520

(56) References Cited

U.S. PATENT DOCUMENTS 4,135,245 * 1/1979 Kemplin et al. ..... 364/520
4,920,357 * 4/1990 Johnson ..... 346/49
5,455,609 10/1995 Gast et al. ..... 347/32

* cited by examiner

*Primary Examiner*—N. Le
*Assistant Examiner*—Anh T. N. Vo

(57) ABSTRACT

A shuttle system transfers an ink-jet pen between a carriage and a shuttle access location on a printer front panel. When a pen load button is pushed, the shuttle will move to an access position. In the access position, the shuttle will open a door and come beyond the front face of the printer. This allows the user to drop the pen(s) into place on the shuttle. Then when the button is pushed again, the pen shuttle will transfer the pens back into the printer, with the door closing, and automatically loads the pen(s) into the printer carriage without manual user intervention. The pen shuttle will then move to a rest position for normal printer operation. If the pen load button is pressed again, the pen shuttle moves back to the carriage and unloads the pen(s) automatically. The pen shuttle again opens the access door and presents the pens to the user. The shuttle has pen wipers and capping structures mounted for movement with the shuttle, allowing for pen service functions to be performed without the need for an additional service station.

37 Claims, 9 Drawing Sheets

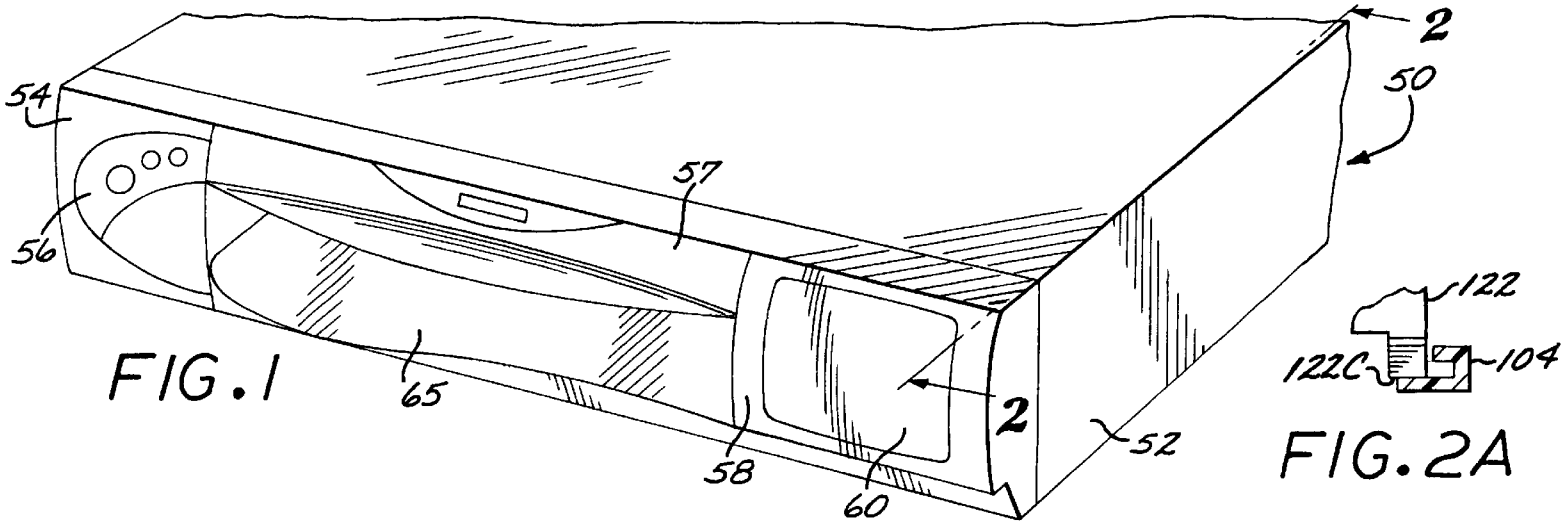
FIG. 1
FIG. 2A
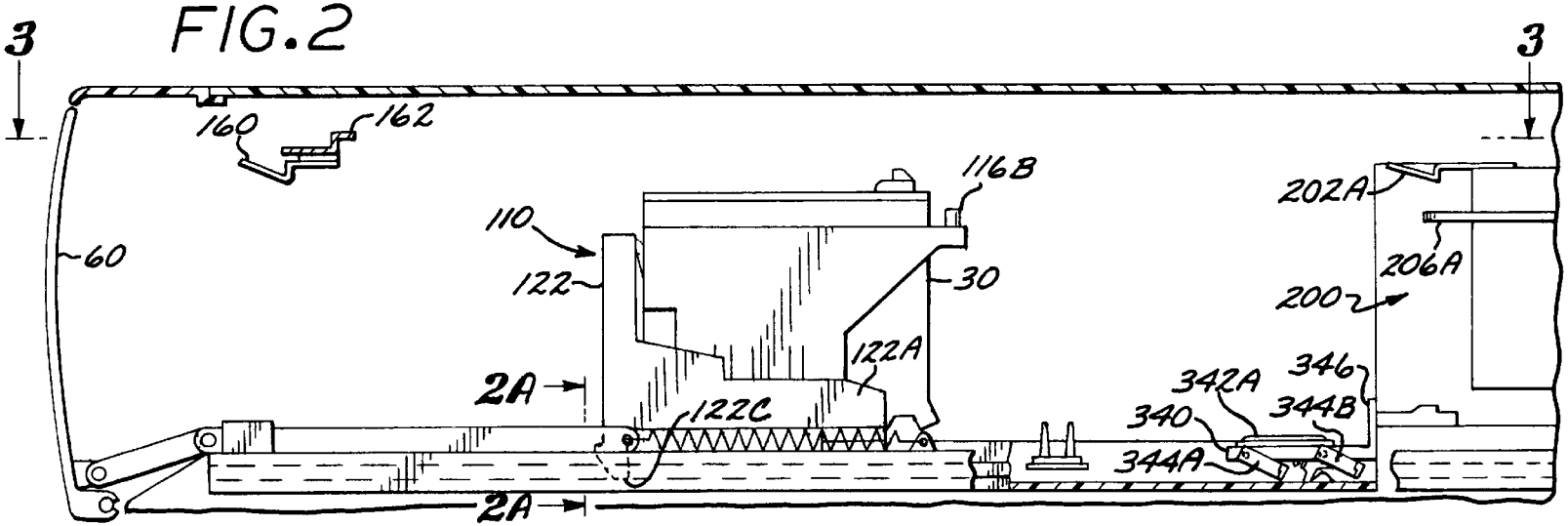
FIG. 2

AUTOMATIC INK-JET PEN LOADING/ UNLOADING

TECHNICAL FIELD OF THE INVENTION

This invention relates to printers utilizing removable printing structures.

BACKGROUND OF THE INVENTION

Printers such as ink-jet printers employ printing elements which require periodic removal and replacement. In the case of ink-jet printers, the printing elements include nozzle arrays typically mounted on pens or print cartridges, and can require periodic replacement as the nozzle array wears out, becomes clogged, or when an internal ink supply becomes exhausted.

In the past, the user has manually inserted and removed the ink-jet pens or print cartridges into receptacles on the printer, e.g. on a traversing carriage. This in turn requires that the receptacles be readily accessible to the user, typically by lifting a cover to gain access. User access becomes problematic for some printers, and so it would be advantageous to provide a solution to the problem of removing and replacing ink-jet pens, print cartridges or other printing elements in a printer in which the user does not have ready access to the receptacle in which the printing element is mounted during printing operations.

SUMMARY OF THE INVENTION

In accordance with an aspect of the invention, a printer is described wherein a pen carrier is provided for transporting the pen from a front panel or other location readily accessible to the user, to the printer carriage receptacle which holds the pen during printing operations. The user simply drops the ink jet pens into position on the carrier, and initiates a load sequence. The carrier then takes the pens and loads them into the carriage for printing. This allows simple loading and unloading of ink-jet pens even when the carriage is buried at the back of the machine and the user only has access to the front face of the machine.

In accordance with another aspect of the invention, a method for loading ink-jet pens into a traversing carriage of an ink-jet printer is described, and includes the following:

loading an ink-jet pen into a pen shuttle positioned at a shuttle access station;

with the carriage positioned at a carriage loading station, moving the pen shuttle from the access station to the carriage loading station;

transferring the pen from the pen shuttle to a pen stall in the carriage.

In accordance with another aspect of the invention, a printer is disclosed, and includes a traversing carriage having a receptacle for holding a printing element during printing operations. A printing element shuttle is arranged for movement along a shuttle path which includes a shuttle access station and a carriage loading station. The printer further has a shuttle drive system for moving the shuttle along the shuttle path, the shuttle and the carriage arranged to transfer a printing element between the carriage and the shuttle with the carriage positioned at the carriage loading station.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is a partially-broken away isometric view of an ink-jet printer embodying aspects of this invention.

FIG. 2 is a side cross-sectional view taken along line 2—2 of FIG. 1, showing the pen carrier.

FIG. 2A is a cross-sectional view taken along line 2A—2A of FIG. 2.

DETAILED DESCRIPTION OF THE PREFERRED EMBODIMENTS

Figure 3:
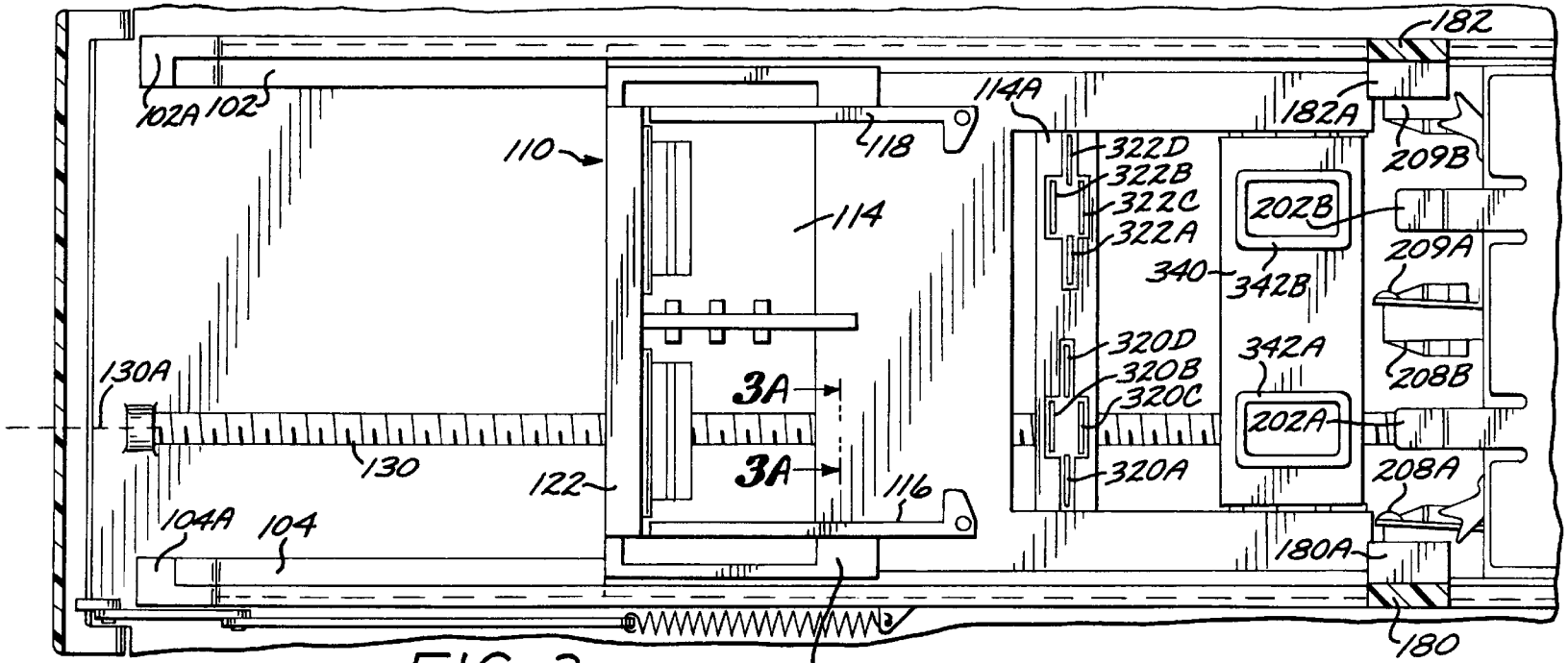
FIG. 3 is a partial top cross-sectional view, taken along line 3—3 of FIG. 2.

FIG. 1 shows an isometric view of a portion of a low profile, stackable inkjet printer 50 embodying aspects of this invention. The printer is particularly adapted for use in a stacked arrangement with other equipment in a cabinet or the like. Thus, other equipment may be stacked over the printer 50. The printer includes an ink-jet pen carriage 200 (FIG. 9) which carries two ink-jet 30, 32 pens during printing operations, disposed at the back of the printer. The carriage is mounted for sliding movement along a slider rod 210, disposed in a generally parallel orientation relative to the front panel of the printer. Thus, with other equipment stacked adjacent the top surface of the printer 50, it would not be possible to access the printer carriage to manually install/remove the inkjet pens on/from the carriage. This invention provides a technique to transport the pens from the front of the printer to the back for loading in the carriage, and for unloading the pens from the carriage and transporting them to the front of the printer.

While the invention is described with respect to an ink-jet printer, aspects of the invention can be employed with other types of printers and other printing structures or elements. For example, the printing structure or element can include or exclude an internal ink reservoir, and the printing structure or element could be an ink reservoir without a device for applying the ink.

The printer 50 includes a housing structure 52 and a front panel 54. The front panel has a set of front panel control switches 56 on one side of the printer, a print media access area 58, and a hinged access door 60 on the opposite side from the switches 56. A pull-out media input tray 55 and a pull-out media output tray 57 are positioned in the center of the front panel. The trays allow the user to access the media trays from the front panel of the machine, without requiring access from the top surface of the machine.

Figure 9:
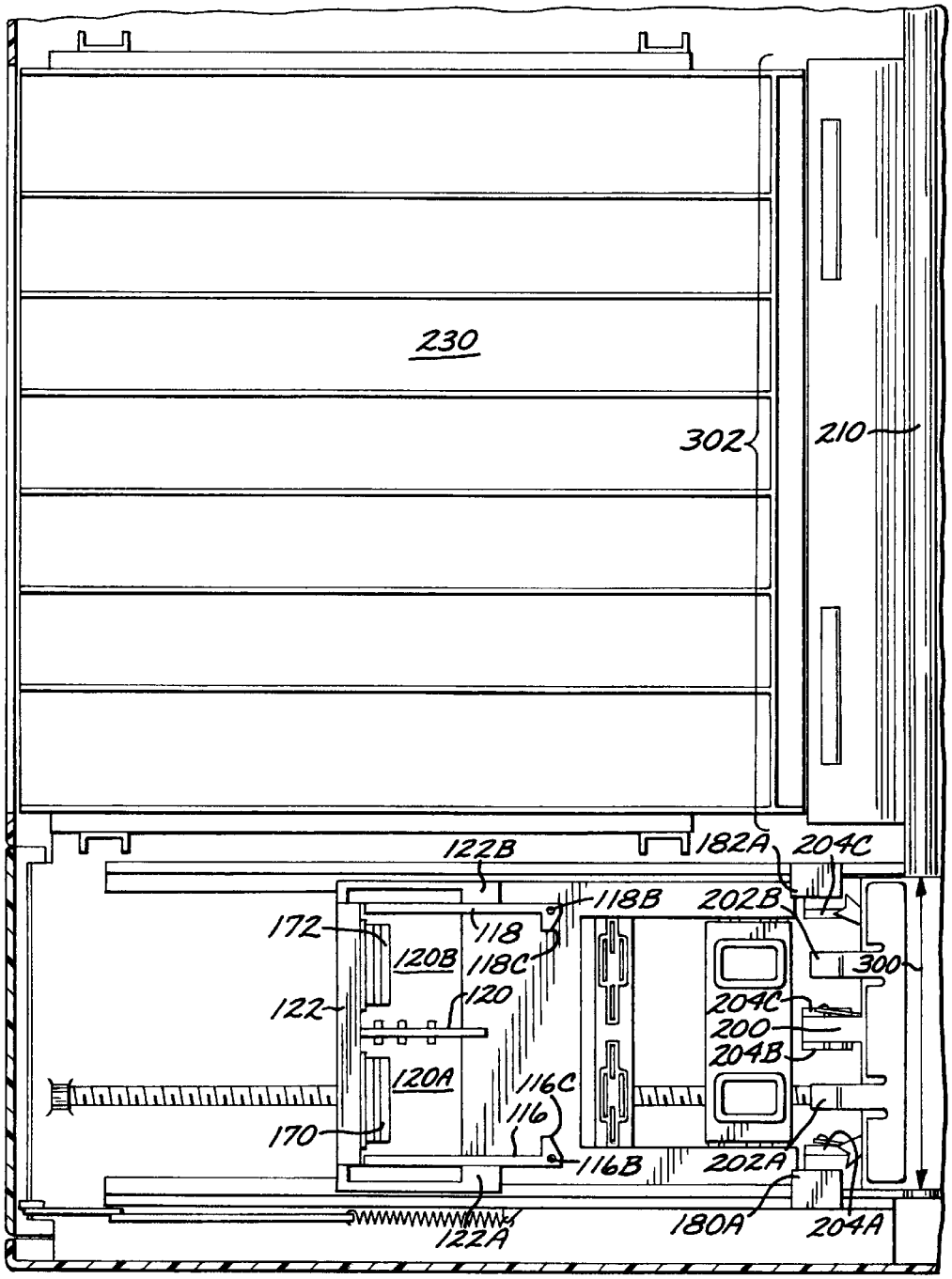
FIG. 9 is a broken-away partial top view of the printer of FIGS. 1–8, showing the carriage, part of the media path, and the shuttle system.

FIG. 9 is a top partially broken-away view of the printer with the top cover removed. This illustrates a portion of the media path and a platen surface 220 which supports the print medium at a print zone. The print medium is advanced from an input supply below output tray surface 230, driven through a 180° change in direction, and positioned on platen surface 220 for printing operations. The printer includes a drive roller system as part of a media advance system to pick a sheet of print medium from the input source, and incrementally advance the sheet through the print zone, after completion of a print swath. The pens are mounted on the carriage for traversal along the slider rod 210 to print each swath. The carriage 200 is positioned in the service station area 302 in FIG. 9. The carriage is driven along the rod 210 to traverse the print area 302 during printing operations.

In accordance with an aspect of the invention, a pen shuttle system 100 is provided for transporting pens between the front panel 54 and a pen load/unload area at the back of the printer. Particularly, the access door 60 provides an access location to a pen shuttle 110, to allow the user to remove pens from the shuttle and place pens in the shuttle for transport to the carriage at the back of the printer. The pen shuttle is shown, e.g.,in FIGS. 2–9.

Figure 4:
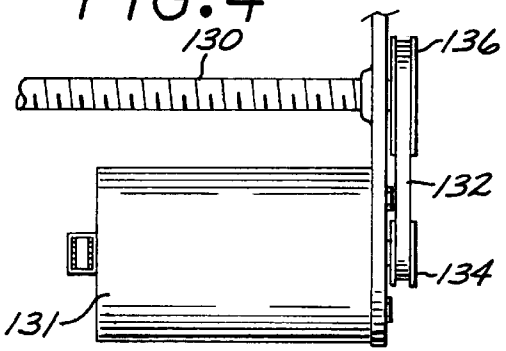
FIG. 4 is an isolation view illustrative of a shuttle motor drive for the printer of FIG. 1.
Figure 3A:
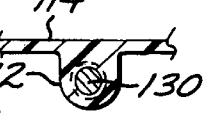
FIG. 3A is a cross-sectional view taken along line 3A—3A of FIG. 3.

The pen shuttle system 100 includes a shuttle 110 mounted for movement along rails 102, 104. In this exemplary embodiment, the shuttle is driven by a leadscrew 130 rotated by a motor drive including motor 130, belt 132 and pulleys 134, 136 (FIG. 4). A threaded traveller nut structure 112 (FIG. 3A) is fixed to the underside of the shuttle floor 114, and is threaded onto the leadscrew, so that rotational movements of the leadscrew are converted into linear movements along the leadscrew axis 130A. Of course, other techniques for driving the shuttle could alternatively be employed, including belt or cable drives, rack and pinion gear drive, and the like.

In this exemplary embodiment, the printer 50 has two pens, one a monochrome pen, the other a tricolor pen, which are carried on the traversing carriage 200 during printing operations. The shuttle 110 is adapted to carry two pens 30, 32 (FIG. 7A) in this embodiment, corresponding to the number of pens carried by the printer carriage, although for other printers, the shuttle can carry a single pen, or more than two pens, as required for the particular printer. The shuttle has an interior wall 120 which defines two shuttle stall spaces 120A, 120B (FIG. 9).

Figure 8A:
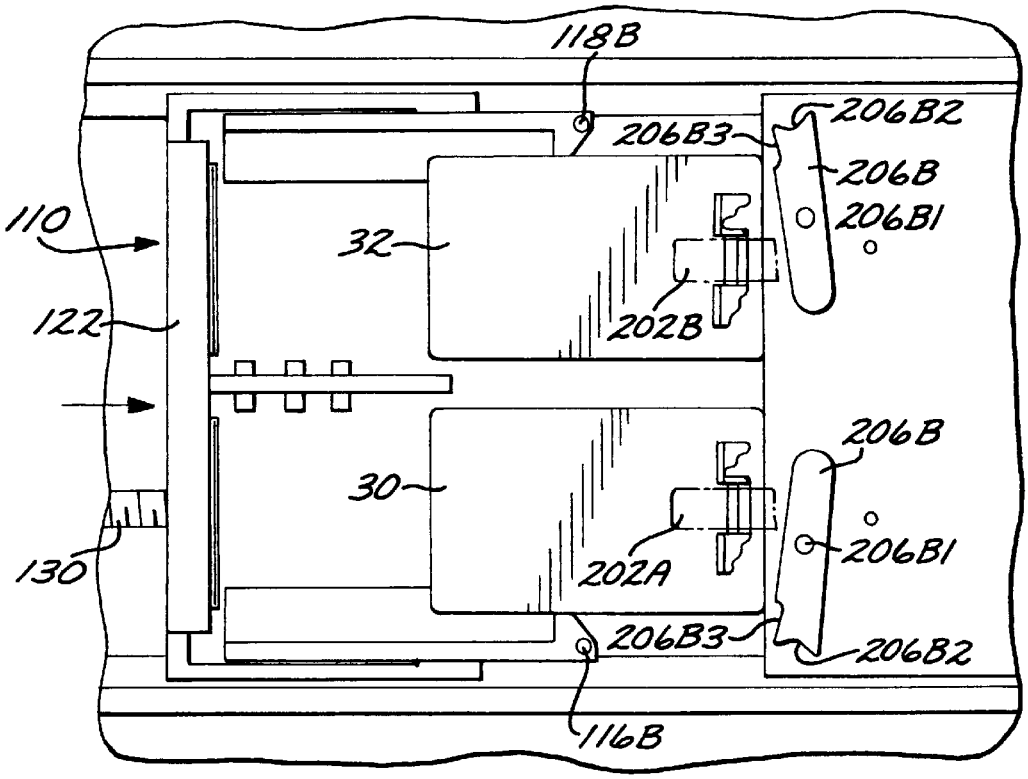
FIGS. 8A–8C illustrate in top views a pen transfer from the carriage to the shuttle.

The shuttle 110 includes a floor structure 114, and opposed side pen latch arms 116, 118, which are hingedly mounted to the floor structure by hinge joints which extend parallel to the axis 130A of movement of the shuttle. For example, hinge joint 116A connects latch arm 116 to the lateral edge of the floor 114. As a result of the connection of the latch arms to the floor structure, the latch arms can pivot outwardly about the hinge joint connection to the floor from upright positions perpendicular to the floor to positions away from the vertical, as shown in FIG. 8A, to be discussed below. Torsion springs bias the latch arms to the upright position. As shown in FIG. 9, for example, each latch arm 116, 118 has formed at a distal end a transverse tab portion 116C, 118C. This tab portion acts as a stop surface to bear against the pen body, and hold the pen in position in the shuttle. Moreover, the distal end of each latch arm has formed therein a feature 116B, 118B which is engaged to open the latch arms as the shuttle engages the carriage.

The shuttle has an interior wall 120 which defines two shuttle stall spaces 120A, 120B (FIG. 9).

The shuttle 110 further includes a shuttle door structure 122 hingedly mounted to the floor structure 114 on a pivot pin 122C (FIG. 2), which extends transversely to the axis 130A. The door structure 122 includes side arms 122A, 122B. The latch arms 116, 118 are constrained from rotating about their pivots when the pens are being loaded into the shuttle by the side arms of the door structure, which are pivoted upwardly as shown in FIG. 5 during a front panel loading process.

A linkage comprising link arms 140, 142 is connected between the pen door 60 and a tension spring 146, attached to a subfloor structure 150 of the printer frame. When the shuttle 110 moves to the front of the printer, the shuttle comes into contact with the hinged door 60, causing the door to pivot open as the shuttle moves to the end of its forward travel, as illustrated in FIG. 5. When the shuttle 110 is moved inside the machine, the spring 148 acts on the linkage to close the pen door 60.

Figure 5:
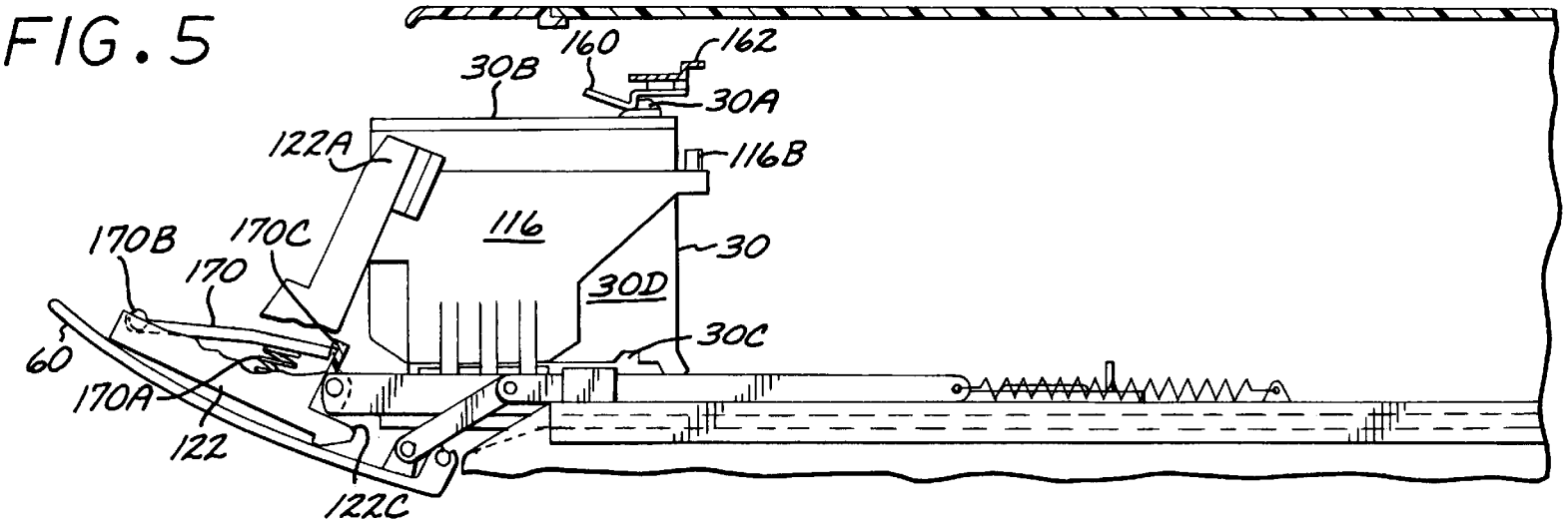
FIG. 5 is a partial side cross-sectional view taken along the same line as for FIG. 2, showing the shuttle in a loading/unloading position at the front of the printer, with the front panel door opened.

FIG. 5 shows one pen 30 and the shuttle 100 in the front load position. A pen latch 160 is fixed to the printer frame structure 162 above the shuttle front load position, one latch for each pen. As the user inserts the pen into the receptacle in the pen shuttle, the pen latch rides over and engages a datum feature 30A formed in the top lid 30B of the pen. The latch 150 holds the pen 30 to the shuttle, preventing the pen from shifting or moving out of the loading position when the shuttle is at the position shown in FIG. 5. The latch also provides tactile feedback to the user that the pen has been properly placed on the shuttle 110. The latch has an "L" shape that engages the corresponding datum surface 30A on the top lid 30B of the pen. As the shuttle 110 is driven by the leadscrew away from the front loading position, the pen 30 is carried away from the latch 160, becoming disengaged from the latch. As the shuttle continues its journey toward the carriage, the pen 30 remains held at a tilted orientation relative to the vertical.

A pen plate 170, 172 (FIG. 9) is provided on the shuttle door 122 for each pen. Each pen plate is spring-loaded to a reference so that when the door 122 is closed, the pen is biased to an angled position offset from the vertical, as shown in FIG. 5B. In this exemplary embodiment, the tilt angle is 7° from the vertical.

Figure 6:
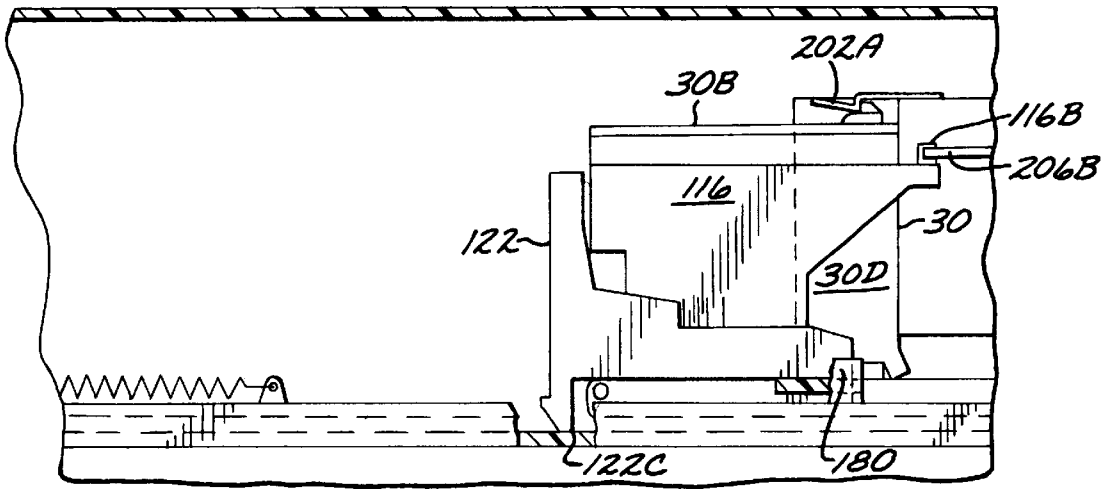
FIG. 6 is a partial side cross-sectional view taken along the same line as for FIG. 2, but showing the shuttle in position at the rear of the printer with the pen transferred between the shuttle and the printer carriage.
Figure 5A:
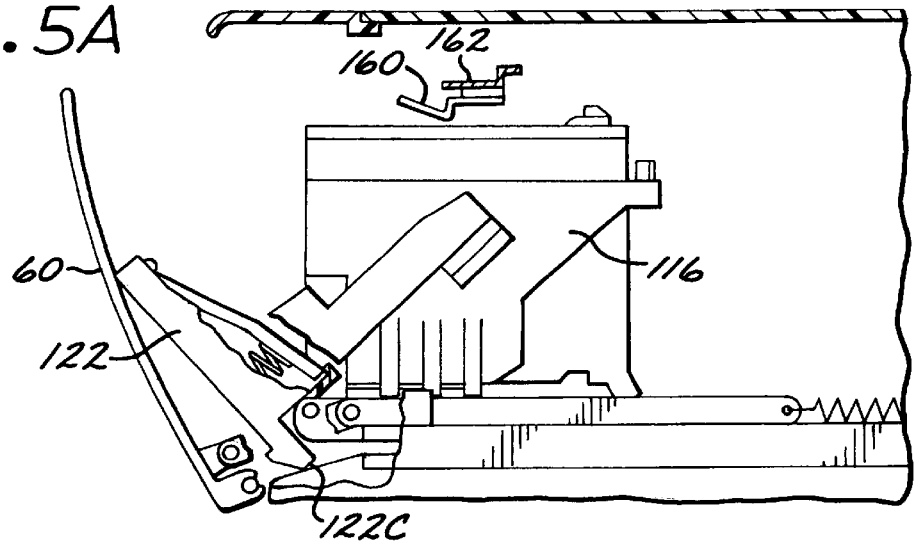
FIG. 5A is a partial side cross-sectional view taken along the same line as for FIG. 2, showing the shuttle being moved from the loading/unloading position.
Figure 5B:
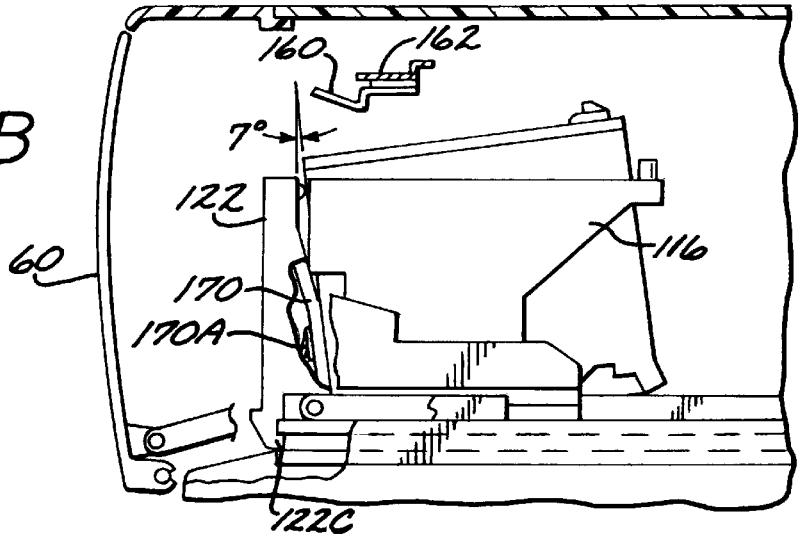
FIG. 5B is a partial side cross-sectional view taken along the same line as for FIG. 2, showing the shuttle being moved away the loading/unloading position, with the front panel door and the shuttle door closed.

FIG. 5A shows exemplary pen plate 170, biased to an outward reference position by a spring 170A. The plate 170 is hinged for movement about pivot 170B. A stop surface structure 170C provides a reference stop to limit the outward movement of the plate to the reference position. When the pen 30 is transferred from the shuttle 110 to the printer carriage 200, as shown in FIG. 6, the orientation of the pen relative to the vertical changes from 7° to 0°, and the spring 170A biasing the pen plate 170 compresses to allow the plate to move inwardly to accommodate the rotation of the pen.

FIG. 5A shows the shuttle positioned 110 at the front of its path of travel, with a pen 30 installed on the shuttle 110 and the front panel door 60 and shuttle door 122 partially closed. The shuttle door opens by its own weight in this position. When the shuttle 110 travels inwardly from the front position, the shuttle door 122 is closed by interaction of door side cam surfaces, e.g. surface 122C, with fixed ramp surfaces 102A, 104A defined on the guide rails 102, 104, as illustrated in FIG. 5B.

Figure 5C:
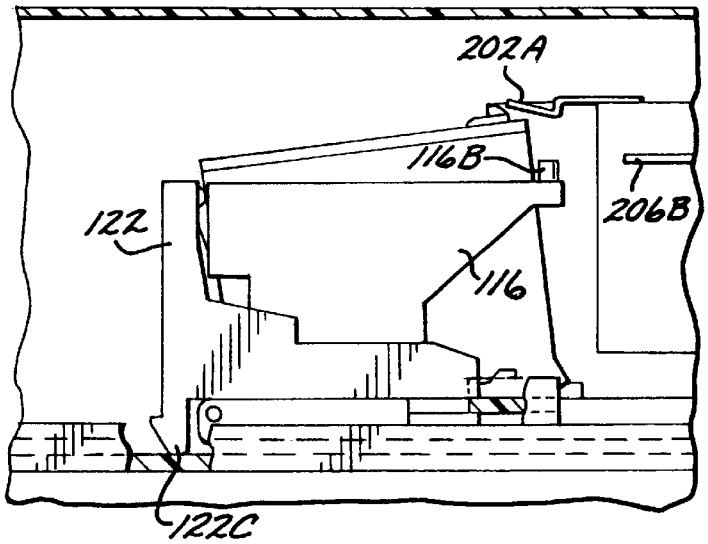
FIG. 5C is a partial side cross-sectional view taken along the same line as for FIG. 2, showing the shuttle approaching the carriage to transfer a shuttle to the carriage.

FIG. 5C shows the pen shuttle 110 moved to its load/unload position relative to the printer carriage 200, to unload the pen into the carriage. As the shuttle approaches the carriage load position at the rear of the printer, the ends of the door arms are captured within a locking channel 180A, 182A defined in respective lock structures 180, 182 located along the guide rails 102, 104 adjacent the carriage service area, preventing the shuttle door from opening. The locking channels permit movement of the ends of the door arms along the direction of the shuttle axis, but constrains the door arms from rotating upwardly or downwardly. This allows the door to exert force against the pen as the shuttle brings the pen into engagement with the carriage, without allowing the door to open. In an exemplary embodiment, the door exerts about 4 pounds of force on the pen as the pen is transferred into engagement with the carriage, and the locking structures prevent the door 122 from pivoting about its hinge in reaction to this transfer force.

The printer carriage 200 is moved away from the service station position 300 (FIG. 9) to provide clearance for the cap sled structure mounted on the shuttle 110 to pass through. Once the sled structure is positioned behind the carriage path of travel, the shuttle is stopped, and the printer carriage is moved to its position at the service station to receive the pens. After the printer carriage is in its stopped position at area 300, the shuttle 110 continues its movement toward the rear of the printer to deliver the pens to the carriage.

Each pen 30, 32 includes datum features used to locate the pen properly in position in the carriage. For example, pen 30 has datum features, e.g. 30C, protruding from the pen body side walls, e.g. side wall 30D (FIG. 5). The top lid feature 30A is used to receive a carriage pen latch spring, which is similar is structure and function to the fixed latch spring 160. Shown in FIG. 9 are the carriage latch springs 202A, 202B, as well as the carriage datum features 204A–204D which engage the pen side wall datum features, e.g. feature 30C. The carriage datum features and the latch springs register the position of the pens in the carriage pen stalls. The carriage also includes electrical interconnect circuitry (not shown) to provide electrical interconnection with the TAB circuit (not shown) on the pens to be able to drive the pen printheads, in a manner well known in the art. The carriage further includes resilient side spring elements 208A, 209B and opposed side wall surfaces 208B, 209B (FIG. 3) to define pen stalls in the carriage. The spring elements are biased to push the adjacent sides of the pens against the opposed side wall surfaces, to hold the pens in position and into engagement with the carriage datum surfaces 204A–204D (FIG. 9).

The pens mounted in the shuttle approaches the carriage with a 7° orientation relative to vertical, to position the pen datums above the carriage datums in order to properly assemble the pen into the carriage stall.

Figure 7A:
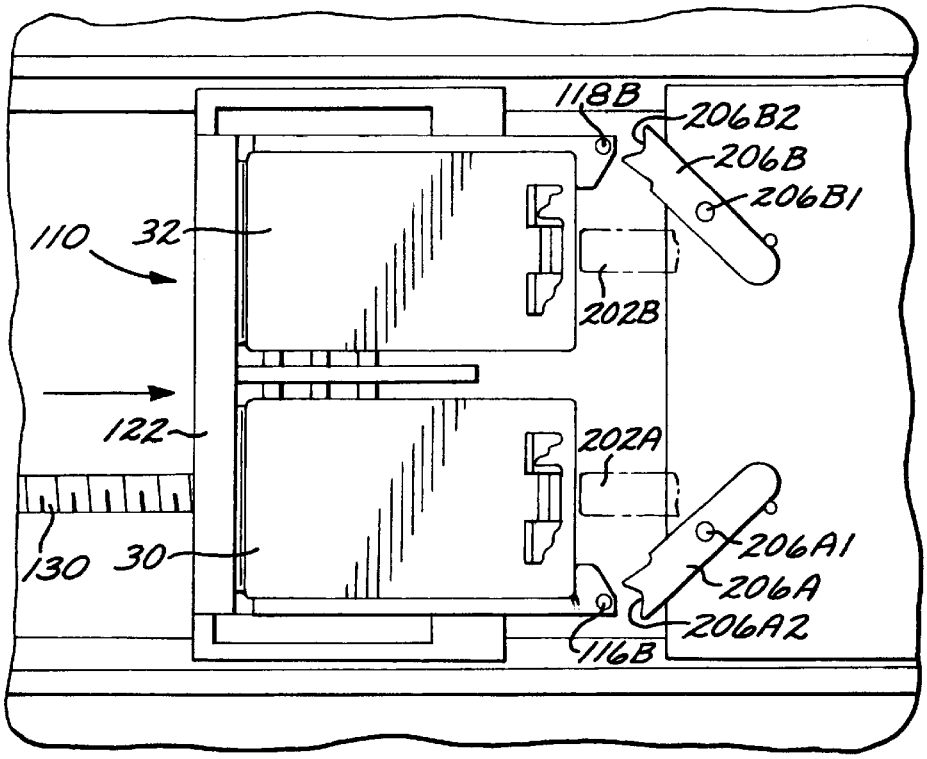
FIGS. 7A–7C illustrate top views of the shuttle loaded with two pens approaching and engaging carriage to transfer the pens from the shuttle to the carriage, and withdrawing after the transfer has been made.

FIG. 7A shows the shuttle with pens 30, 32, approaching the carriage 200, which is positioned in the loading position at the service station area 302 (FIG. 9). The respective carriage latch springs 202A, 202B enters the corresponding top lid datum feature 30A, 30B. Once the pen datum enters the corresponding carriage datum feature, the angle of the pen on the shuttle starts changing from the 7° offset to 0°, i.e. to a vertical orientation. As this occurs, the carriage spring is deflected upwardly as it touches the top lid datum feature. As the shuttle continues its rearward motion, the pen drops into position, with the pen datum, e.g. 30C, behind the carriage datum feature, e.g. 204A. As the pen angle changes on the shuttle, the corresponding pen plate spring, e.g. 170A, is compressed to accommodate the change in pen angle.

Figure 7B:
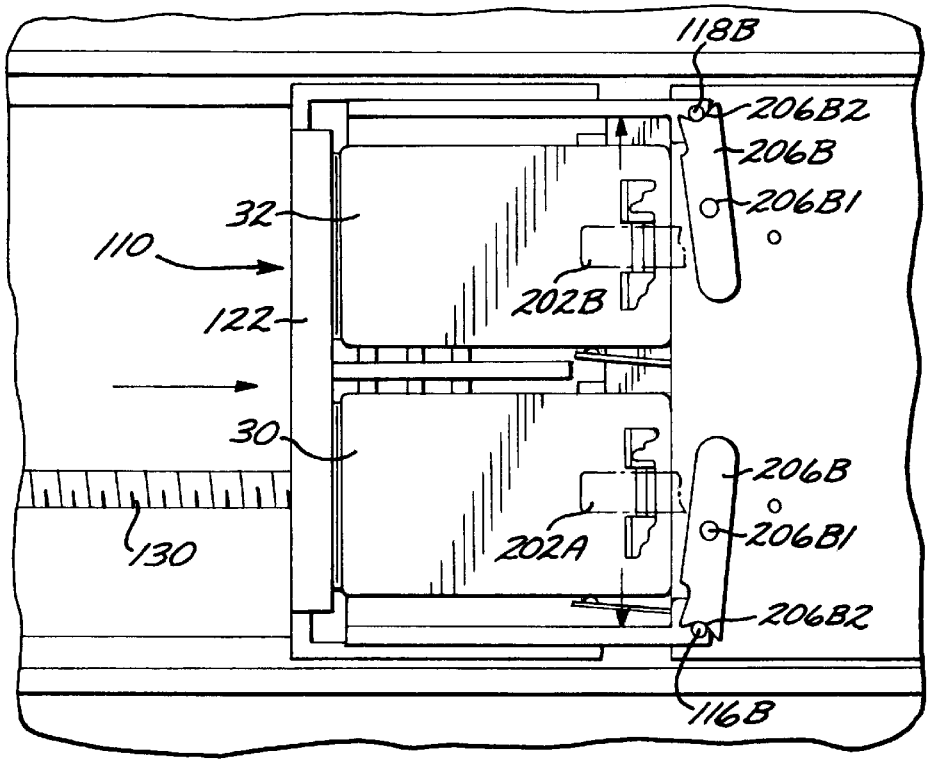

Another aspect of the pen delivery is the rotation of the latch arms 116, 118 to release the pen to the carriage. This is accomplished by the pins 116B, 118B on each latch arm coming into contact with a rotatable pen link 206A, 206B mounted on the carriage. The links are arranged to rotate about a pivot 206A1, 206B1 as the respective pin 116B, 118B engages link end 206A2, 206B2, and are spring-loaded to the position shown in FIG. 7A. Continued motion of the shuttle 110 in the rearward direction provides a resultant force on the latch arms 116, 118 exerted by the links to rotate the latch arms and links outwardly as shown in FIG. 7B, pushing the transverse tab portion 116A, 118A away from the corners of the respective pen bodies, releasing the pens to the carriage.

Figure 7C:
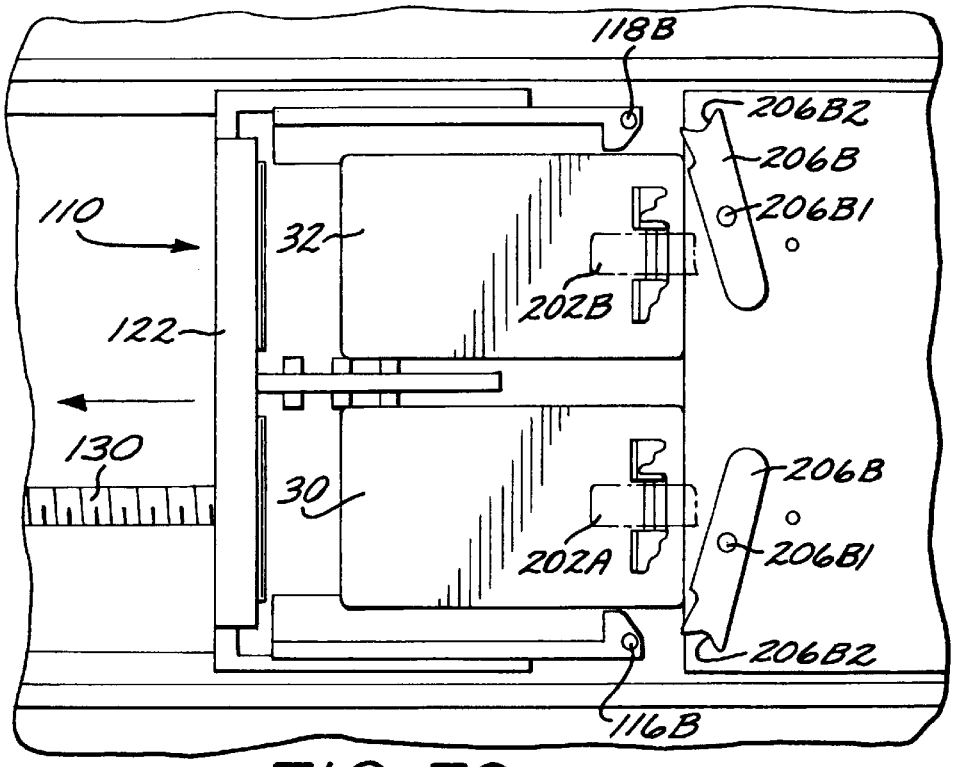

FIG. 7C shows the shuttle 110 moving in the reverse direction toward the front of the printer, with the pens transferred to the carriage 200. Now the latch arms 116, 118 have left their contact with the links 206A, 206B, and are riding along the side walls of the pens, now secured in the carriage. Once the shuttle 110 is moved sufficiently toward the front of the printer that the latch arms are out of contact with the pens and carriage, the shuttle can be stopped in a rest position, with the wiper blades and capping sled positioned still behind the path of travel of the carriage. The carriage can now be moved to the print area 302 for printing operations. Alternatively, the shuttle can be moved further to the front of the printer, so that the wipers and capping sled are also in front of the carriage travel.

Figure 8B:
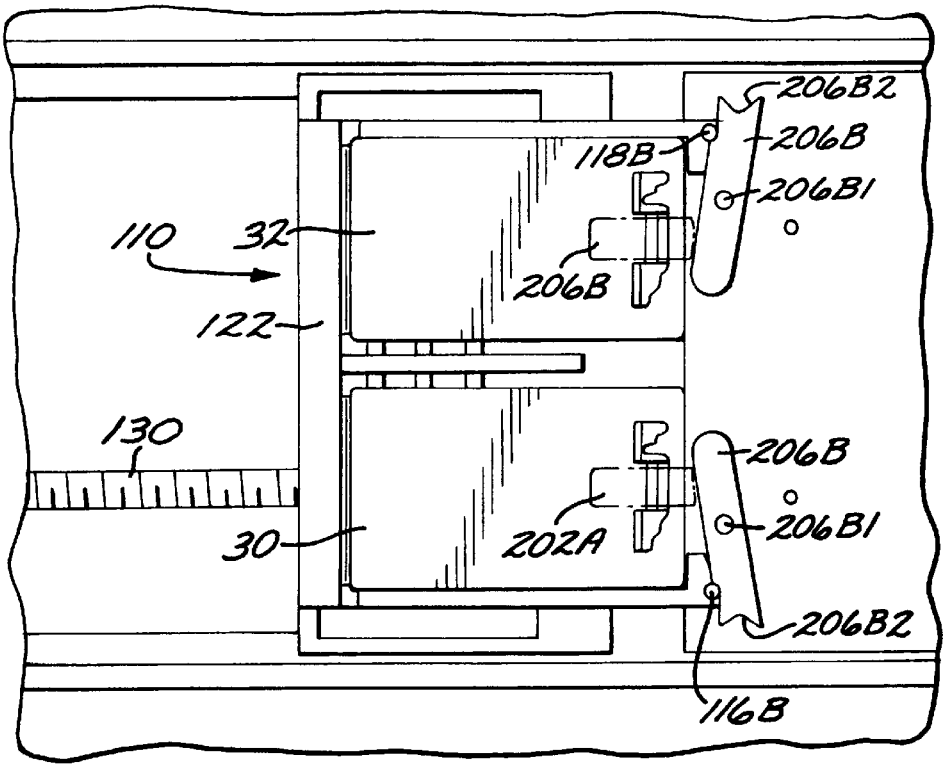
Figure 8C:
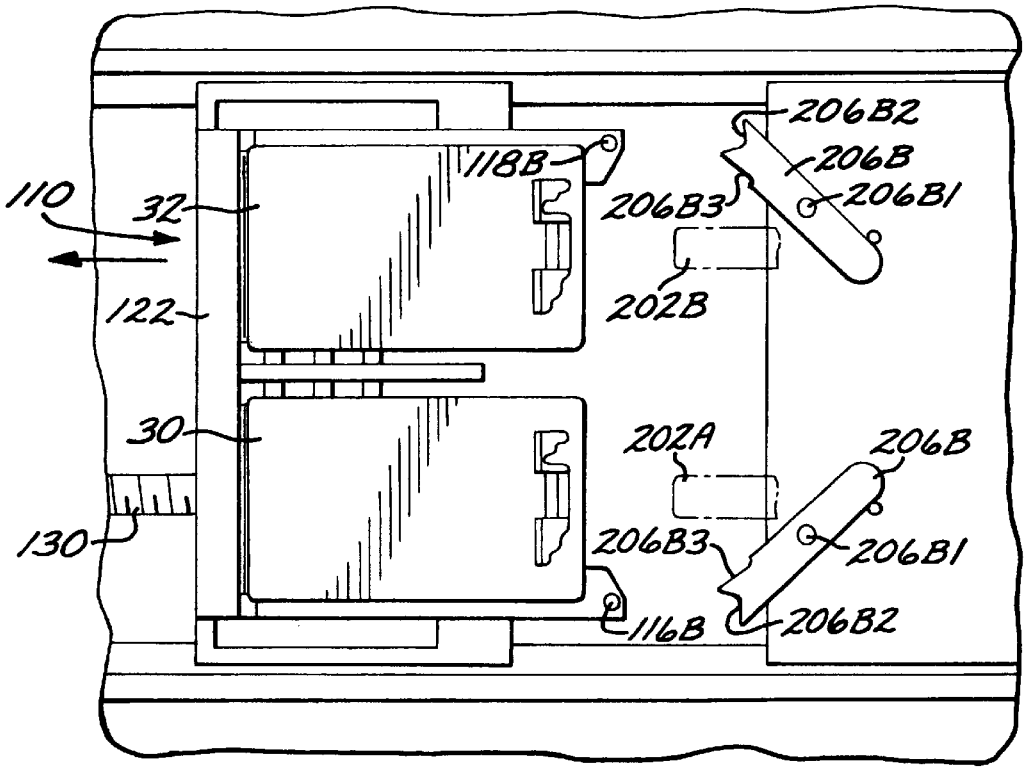

FIGS. 8A–8C show a sequence for retrieving the pens from the carriage using the shuttle 110. The shuttle and carriage are first respectively positioned such that the carriage is in the service station area 300 with the capping sled and wipers behind the carriage. In order to retrieve the pens from the carriage 200, the shuttle will move toward the rear of the printer toward the carriage. Now the pen links 206A, 206B are held back away from contact with the latch arms pins 116B, 118B by the pens 30, 32 in the carriage stalls. Now the pen latch arm pins 116B, 118B will engage respective features 206A3, 206B3 on the pen links 206A, 206B instead of features 206A2, 206B2, allowing the latch arms tab portions 116A, 118A to engage the pens (FIG. 8B). Now the shuttle 110 is driven toward the front of the printer. As this occurs, the latch arms pull the pen free of the carriage, so that the pen is now mounted on the shuttle. The links 206A, 206B will return by action of their bias springs to the pen load position shown in FIG. 7A.

The shuttle 110 also carries service station components, to perform wiping, spitting and capping functions. These components include wiper blades 320A–320D, 322A–322D (FIG. 3), and a sled structure 340 carrying cap structures 342A, 342B for capping pen nozzles for the pens mounted in the printer carriage. The wiper blades are fixed in position on a shuttle floor portion 114A. Wiper blades are provided to wipe not only the nozzle arrays of the pens, but also the sides of the pens adjacent each side of the nozzle arrays, where ink can collect. For wiping operations, the shuttle is positioned at the rear of the printer, in a position such that the shuttle stalls and latch arms are forward of the carriage path of travel, and the capping sled is behind the carriage path of travel. Now the carriage 200 holding the pens 30, 32 is moved to the service position 300. With the carriage 200 fixed in position, the shuttle motor 231 is actuated to drive the shuttle along its axis, which is transverse to the direction of carriage movement. The wipers engage the pen nozzles arrays to wipe accumulated dried ink and debris from the nozzle plate. Wiper blades for accomplishing this function are known, and are described, e.g. in U.S. Pat. No. 5,455,609. The wipers also engage the sides of the pen adjacent each side of the nozzle array to wipe the adjacent pen surfaces.

The shuttle also accommodates a nozzle array ink spitting function. The floor of the printer beneath the service station area is provided with a layer of absorbent material. The shuttle can be positioned so that the open space between the wipers and the capping sled is positioned directly beneath the pen nozzle arrays with the pens supported on the carriage. The pens can energized to spit ink droplets, which are collected by the absorbent material.

The capping sled 340 is mounted on four link arms, including link arms 344A, 344B (FIGS. 2, 2B), each of which have one end pivotally mounted on the shuttle subfloor 114B and the other pivotally mounted to a corner of the sled. A spring guide 348 is also pivotally mounted to the shuttle floor, and carries a coil spring 348A which engages the bottom of the sled. With this arrangement, the sled can be rotated between a down position (FIG. 2), wherein the link arms define a small angle with respect to the shuttle subfloor, and an upright position (FIG. 2B) with the sled 340 elevated above the subfloor and the link arms defining a right angle relative to the floor. A tab feature 346 protrudes upwardly from the sled and is for contacting a rear wall surface 200A of the carriage.

Figure 2B:
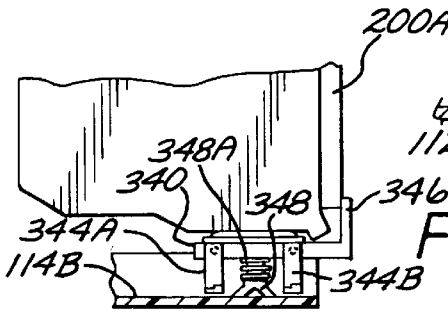
FIG. 2B is a side cross-sectional view showing the capping of a pen at the service area.

To engage the caps 342A, 342B carried on the sled 340 with the pens to cap the pen nozzle arrays, the shuttle is positioned in a rearward position, with the shuttle pen stalls and latch arms located forwardly of the carriage path of travel, and the sled located behind the carriage path of travel. Now the carriage holding the pens is brought to the service station position 300 and stopped. The shuttle motor 131 is driven to move the shuttle toward the front of the printer. The tab feature 346 on the sled engages the back wall surface 200A of the carriage. As the shuttle continues to move forward, the engagement of the tab with the carriage wall results in rotation of the sled link arms upwardly, lifting the sled into a capping position (FIG. 2B). As the caps come into contact with the pen printhead area, the spring 348A allows some compliance movement of the sled relative to the pens. The shuttle is held in this position until the printer is ready for printing or other operation. Now the shuttle will be moved back toward the rear of the printer. This allows the link arms to rotate downwardly, such that the sled 340 drops down, disengaging the caps from the pens. Once the sled is clear of the carriage and pens, the carriage can be moved out of the service station position to the print area 302.

A sled mounted on four pivoted link arms has been used in the past, e.g. the Hewlett-Packard PhotoSmart (TM) photo printer. However, that printer employed a separate motor drive to move the sled transverse to the carriage travel. According to an aspect of this invention, the wiping and capping functions are incorporated in the pen shuttle, so that the drive needed for wiping and capping is shared with the pen shuttle.

It will be appreciated that the wiping and capping functions could be separated from the pen shuttle functions. In this case, the pen shuttle would not include wipers and caps, and need only employ the features needed to transfer pens between the front load/unload position and the carriage.

Figure 10:
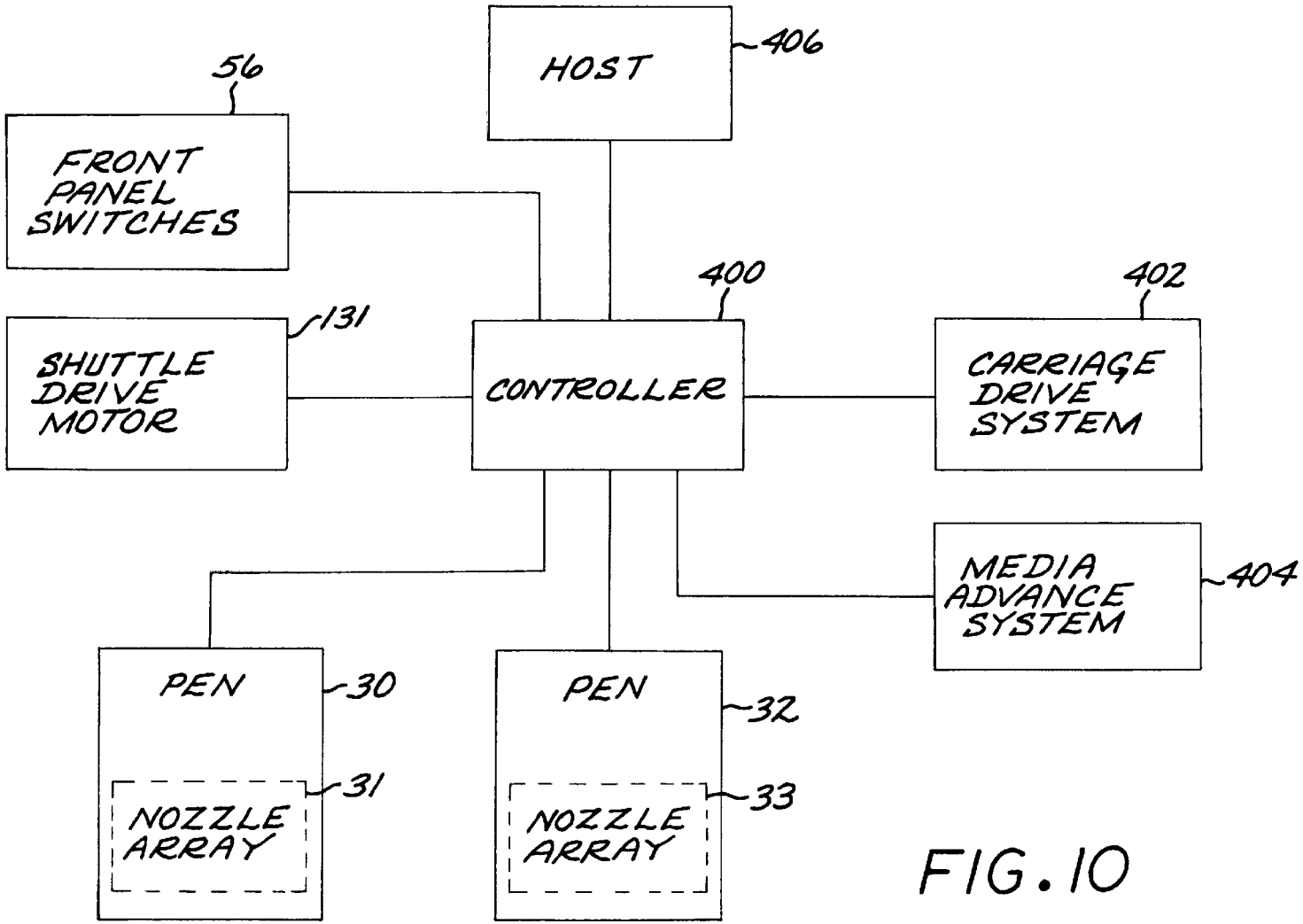
FIG. 10 is a simplified control block diagram of the printer of FIGS. 1–9.

FIG. 10 is a control block diagram for the printer 50. The printer includes a controller 400, e.g. a microprocessor or ASIC, which is programmed to control the printer operation. The controller receives print jobs from a host 406, e.g. a personal computer, digital camera, or other source of print data, and acts to activate the media advance system 404 to advance the print medium from the printer input tray through a print zone. The carriage holding the pens 30, 32 is driven by the carriage drive system 402 across the print zone, and the controller generates printhead firing commands to cause droplets of ink to be ejected from the respective nozzle arrays 31, 33 of the pens 30, 32 in a controlled manner. The print medium can be incrementally advanced through the print zone by the media advance system 404 to position fresh portions of the medium at the print zone after completion of carriage swaths. Upon completion of a print job, the media advance system moves the medium to the output tray of the printer. The controller drives the shuttle drive motor 131 at appropriate times in response to front panel switches 56, to load or unload a pen from the carriage. Alternatively, commands to initiate a load/unload operation could be generated by the controller automatically, say in response to an out-of-ink determination.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for loading a printing element into a traversing carriage of a printer, comprising:

loading the printing element into a shuttle receptacle of a shuttle positioned at a shuttle access station, the printing element including a body structure comprising first and second generally planar and orthogonal sidewalls, the body structure being engaged by corresponding receptacle surfaces such that the printing element is mounted within the shuttle receptacle in a uniquely defined orientation;

with the carriage positioned at a carriage loading station, moving the shuttle from the access station to the carriage loading station;

transferring the printing element directly from the shuttle receptacle to a printing element stall in the carriage.

2. The method of claim 1 wherein said transferring occurs automatically without any manual intervention.

3. The method of claim 1, wherein the step of loading the printing element into the shuttle includes manually placing the printing element in the shuttle receptacle.

4. The method of claim 3 wherein said step of loading the printing element into the shuttle further includes engaging the printing element with a latch to hold the printing element in said uniquely defined orientation for commencement of a printing element loading movement by the shuttle.

5. The method of claim 1 further including:

engaging the printing element with a latching structure to support the printing element in the shuttle receptacle in said uniquely defined orientation during movement of the shuttle from the access station to the carriage loading station.

6. The method of claim 5 further including:

automatically disengaging the latch structure from the printing element at the carriage loading station to permit said transferring to occur.

7. The method of claim 1 wherein said carriage printing element stall is for mounting the printing element during printing operations, the carriage stall including a stall datum feature, and wherein the printing element includes a printing element datum feature adapted for engaging the stall datum feature for registering the position of the printing element in the stall, the method further including:

automatically engaging the printing element datum feature with the stall datum feature during said transferring of the printing element from the printing element shuttle to the printing element stall to register the position of the printing element in the stall.

8. The method of claim 7, wherein said transferring further includes:

holding the printing element at an angular orientation offset from a vertical orientation as the printing element datum feature is engaged with the stall datum feature to facilitate a proper seating of the printing element datum feature with the stall datum feature, and then moving the printing element to the vertical orientation within the carriage stall.

9. The method of claim 1 wherein the shuttle access location is positioned at a printer front panel, and the carriage loading station is located behind the front panel at a position not accessible for manual loading of the printing element in the carriage stall.

10. The method of claim 9 wherein the carriage loading station is located adjacent a rear part of the printer, and wherein the shuttle has a path of travel which extends generally transverse to a carriage scanning axis.

11. The method of claim 1, wherein the shuttle further has mounted therein printing element servicing apparatus, and further including:

moving the shuttle to perform a printing element servicing function.

12. The method of claim 1 wherein said printing element includes an ink-jet pen including an array of nozzles for ejecting ink droplets during printing operations, and said printer is an ink-jet printing system.

13. A method for unloading one or more inkjet pens from a traversing carriage of an ink-jet printer, the ink-jet pens including a nozzle array for ejecting droplets of ink during printing operations, comprising:

providing a pen shuttle movable between a shuttle access station and a carriage unloading station, the pen shuttle having one or more shuttle receptacles for holding the one or more ink-jet pens in a unique orientation;

with the carriage positioned at the carriage loading station and the one or more ink-jet pens mounted in corresponding one or more pen stalls of the carriage, moving the pen shuttle to the carriage loading station;

transferring the one or more ink-jet pens directly from corresponding one or more pen stalls in the carriage to corresponding one or more shuttle receptacles of the pen shuttle, each of the one or more ink-jet pens including a body structure comprising first and second generally planar and orthogonal sidewalls, the body structure being engaged by corresponding shuttle receptacle surfaces such that the one or more ink-jet pens is mounted within the shuttle receptacle in a uniquely defined orientation;

moving the shuttle from the carriage unloading station to the shuttle access location.

14. The method of claim 13, wherein said transferring occurring automatically without any manual intervention.

15. The method of claim 13, further comprising:

manually removing the one or more ink-jet pens from the shuttle at the shuttle access location.

16. A printer, comprising:

a replaceable printing element including a body structure comprising first and second generally planar and orthogonal sidewalls;

a traversing carriage having a receptacle for removably holding the printing element during printing operations;

a printing element shuttle arranged for movement along a shuttle path, the shuttle path including a shuttle access station and a carriage loading station, the shuttle including a shuttle receptacle and receptacle surfaces for engaging the body structure of the printing element to hold the printing element within the shuttle receptacle in a unique orientation while the printing element is held in the receptacle and the shuttle is moving along the shuttle path;

a shuttle drive system for moving the shuttle along the shuttle path, the shuttle and the carriage arranged to transfer the printing element directly between the carriage receptacle and the shuttle receptacle with the carriage positioned at the carriage loading station.

17. The printer of claim 16 wherein said transferring occurs automatically without any manual intervention.

18. The printer of claim 16, further comprising a front panel access door through which the printing element is manually loaded or unloaded from the shuttle.

19. The printer of claim 16 further comprising a latch to hold the printing element in proper position for commencement of a pen loading movement by the shuttle.

20. The printer of claim 16 further including a latching structure to support the printing element in the shuttle receptacle in said unique orientation during movement of the pen shuttle between the access station and the carriage loading station.

21. The printer of claim 20 further including carriage mounted link apparatus for automatically disengaging or engaging the latch structure on the printing element at the carriage loading station to permit said transferring to occur.

22. The printer of claim 16 wherein said carriage receptacle includes a carriage datum feature, and wherein the printing element includes a printing element datum feature adapted for engaging the carriage datum feature during a transfer from the shuttle to the carriage receptacle for registering the position of the pen in the receptacle.

23. The printer of claim 22, wherein the shuttle further includes a movable plate structure for holding the pen at an angular orientation offset from the vertical as the pen datum feature is engaged with the stall datum feature to facilitate a proper seating of the pen datum feature with the stall datum feature.

24. The printer of claim 16 wherein the shuttle access location is positioned at a printer front panel, and the carriage loading station is located behind the front panel.

25. The printer of claim 24 wherein the carriage loading station is located adjacent a rear part of the printer which is inaccessible to a printer user during normal use of the printer, and wherein the shuttle has a path of travel which extends generally transverse to a carriage scanning axis.

26. The printer of claim 16, wherein the shuttle further has mounted therein printing element servicing apparatus, and the shuttle drive system is adapted to move the shuttle to perform a printing element servicing function.

27. The printer of claim 26, wherein the printing element is an ink-jet pen having a nozzle array, and said printing element servicing apparatus includes a pen nozzle wiper blade, and said shuttle drive system moves the shuttle while the carriage has the pen mounted in said carriage receptacle and is located at the loading station to pass the wiper blade across a pen nozzle surface.

28. The printer of claim 26, wherein the printing element is an ink-jet pen having a nozzle array, and said printing element servicing apparatus includes a pen nozzle capping apparatus, and shuttle drive system moves said shuttle while the carriage has the pen mounted in said carriage receptacle and is located at the loading station to position the capping apparatus for a capping function.

29. A method for loading printing elements into a traversing carriage of a printer, comprising:

loading a printing element into a shuttle positioned at a shuttle access station, the shuttle having printing element servicing apparatus;

with the carriage positioned at a carriage loading station, moving the shuttle from the access station to the carriage loading station;

transferring the printing element from the shuttle to a printing element stall in the carriage; and moving the shuttle to perform a printing element servicing function using said printing element servicing apparatus.

30. The method of claim 29, wherein said printing element is an ink-jet pen having a pen nozzle surface, and said printing element servicing apparatus includes a pen nozzle wiper blade, and said moving said shuttle to perform a printing element servicing function includes moving the shuttle while the pen is mounted in said carriage stall to pass the wiper blade across the pen nozzle surface.

31. The method of claim 29, wherein said printing element is an ink-jet pen, and said printing element servicing apparatus includes a pen nozzle capping apparatus, and said moving said shuttle to perform a pen servicing function includes moving the shuttle while the pen is mounted in said carriage stall and the carriage is located at the loading station to position the capping apparatus for a capping function.

32. A method for simultaneously loading a plurality of printing elements into a traversing carriage of a printer, comprising:

loading the plurality of printing elements into respective shuttle receptacles of a shuttle positioned at a shuttle access station;

with the carriage positioned at a carriage loading station, moving the shuttle from the access station to the carriage loading station; and simultaneously transferring the plurality of printing elements directly from the shuttle to respective printing element stalls in the carriage without manual intervention.

33. The method of claim 32 wherein the respective shuttle receptacles are arranged in a side-by-side configuration in the shuttle, and the respective carriage stalls are arranged in a corresponding side-by-side configuration in the carriage.

34. The method of claim 32 wherein the step of loading the plurality of printing elements into the shuttle includes manually placing the plurality of printing elements in the plurality of corresponding shuttle receptacles.

35. The method of claim 32 wherein the shuttle access location is positioned at a printer front panel, and the carriage loading station is located behind the front panel at a position not readily accessible for manual loading of the plurality of printing elements in the respective carriage stalls.

36. The method of claim 35 wherein the carriage loading station is located adjacent a rear part of the printer, and wherein the shuttle has a path of travel which extends generally transverse to a carriage scanning axis.

37. The method of claim 35 wherein said plurality of printing elements includes a plurality of ink-jet pens, and said printer is an ink-jet printing system.

* * * * *